US005916003A

United States Patent [19]

Masini et al.

[11] Patent Number: 5,916,003

[45] Date of Patent: Jun. 29, 1999

[54] PROPELLER VENT PLUG WITH FLUID PASSAGE

[75] Inventors: Paul A. Masini; Michael P. Mihelich, both of Fond du Lac; William P. Lang, Oshkosh, all of Wis.

[73] Assignee: Brunswick Corporation, Lk. Forest, Ill.

[21] Appl. No.: 08/971,350

[22] Filed: Nov. 17, 1997

[51] Int. Cl.[6] ..... B63H 21/10

[52] U.S. Cl. ..... 440/89; 416/93 A

[58] Field of Search ..... 440/66, 89; 416/23, 416/90 R, 90 A, 93 R, 93 A, 245 A

[56] References Cited

U.S. PATENT DOCUMENTS 4,545,771 10/1985 Iio ..... 440/89

4,802,872 2/1989 Stanton ..... 440/89

*Primary Examiner*—Stephen Avila

*Attorney, Agent, or Firm*—William D. Lanyi

[57] ABSTRACT

A propeller device is provided with vent apertures and plugs which fit into the vent apertures to be retained in position during use of the propeller device. The vent plugs are provided with openings therethrough so that fluids can flow from a region within a hub of the propeller device to a region proximate the outer cylindrical surface of the hub. The fluids flowing from the internal portion of the hub flow towards regions of low pressure near the propellers. The plugs can be changed to modify the size of the ventilation aperture without having to change the propeller device itself. One embodiment of the plug is provided with a moveable cover that closes the opening progressively in response to increasing rotational speed of the propeller device.

12 Claims, 4 Drawing Sheets

PROPELLER VENT PLUG WITH FLUID PASSAGE

BACKGROUND OF THE INVENTION

1. Field of the Invention

The present invention relates generally to propellers and, more particularly, to a propeller device with a vent plug which has an opening formed therethrough to allow a pre-selected flow of fluid to pass from a region within a hub of the propeller device to a region proximate the outer surface of the hub at a position near a propeller blade where the pressure is reduced when the propeller device rotates about a central axis of the propeller hub.

2. Description of the Prior Art

Many different types of propeller devices are known to those skilled in the art. In some applications, particularly if the propeller blades have a high pitch, the marine propulsion system may experience an unsatisfactory acceleration performance. For example, if the engine does not have sufficient power, a sudden throttle demand can overload the engine and, in some extreme instances, actually cause the engine to stall. There are two possible reasons for this phenomenon. First, during initial acceleration from a standstill condition, the propeller blades must accelerate an annular volume of water described by the blades as they rotate about the centerline of the propeller device. This effort is not assisted by movement of the boat through the water. Secondly, most engines exhibit a horsepower versus RPM characteristic which results in significantly decreased horsepower output from the engine at low speeds. Until the rotational speed of the engine reaches a certain magnitude, the power output from the engine is significantly reduced. Both of these circumstances exist during initial acceleration from a standstill condition.

Propeller blades with a high pitch are typically selected for high speed applications, but they can make it more difficult to accelerate the boat to a sufficient speed to achieve a planing condition. Naturally, if the engine of the boat has sufficient power, this potential acceleration problem can be overcome.

One solution to the above-described problem is to provide a ventilation hole in the hub of the propeller in order to allow exhaust gases to pass through the ventilation hole, in a radially outward direction, from within the propeller hub to a region at the outer cylindrical surface of the hub near the propeller blades. These ventilation holes are typically provided at regions where low pressure zones will be developed behind the blades as a result of the rotation of the propeller device. When ventilation holes are provided, exhaust gas is allowed to pass from the region within the propeller hub, through the ventilation, and into the water within the annular volume described by the path of the propeller blades. By displacing some of the water within this annular volume, the presence of exhaust gases creates an environment surrounding the propeller blades through which is easier for the blades to move. In other words, during acceleration of the propeller device, the presence of exhaust gases in the region swept by the propeller blades displaces water away from this region and facilitates the rotation of the propeller. This concept is well-known to those skilled in the art, and ventilation holes have been provided in several types of propeller devices.

If a propeller device with a ventilation hole is used in conjunction with an engine that has more than sufficient power to satisfy the acceleration needs of the marine vessel on which it is used, the existence of the ventilation hole can possibly cause a situation referred to by those skilled in the art as "breaking loose" by the propeller blades. The symptom of this condition is a sudden increase in speed of the engine and propeller with a corresponding decrease in the power of the engine which is being efficiently applied to move the boat through the water. Typically, the only solution to this deleterious condition is to rapidly decrease throttle demand and allow the propeller to begin to operate properly before reaccelerating.

Therefore, a propeller with a ventilation hole that will operate satisfactorily under one set of conditions will not necessarily operate properly under another set of conditions. If a propeller with a ventilation hole is used on a boat with an engine having limited power, it can be advantageous and can assist during acceleration modes. That same propeller device, however, if placed on another boat with a much more powerful engine, will likely cause "breaking loose" of the propeller blades. As a result, owners of powerful boats typically place plugs in the ventilation holes to essentially avoid the intended function of the ventilation hole. The use of plugs for these purposes creates an "all or nothing" situation where the propeller device must either be used with the full sized ventilation holes which were cast into the propeller device during initial manufacture or, alternatively, with completely blocked ventilation holes that were originally provided with the propeller device.

It would therefore be significantly beneficial if a device could be developed which allows for the originally cast ventilation holes to be modified in a manner that does not require the complete blockage of the holes when the originally cast ventilation hole is too large for a particular application.

SUMMARY OF THE INVENTION

A preferred embodiment of the present invention provides a propeller device that comprises a propeller hub that has a propeller blade extending therefrom. The propeller hub has a central axis about which it rotates. An aperture is formed through a thickness of the propeller hub to connect a region within the propeller hub in fluid communication with a region proximate an outer surface of the propeller hub. A plug, having a diametric profile shaped to be received and retained within the aperture formed through the thickness of the propeller hub is provided and can be inserted into the aperture. An opening is formed through the plug, and the opening provides fluid communication between the region within the propeller hub and the region proximate the outer surface of the propeller hub when the plug is disposed within the aperture.

The aperture can be disposed proximate a side of the blade which experiences a reduced pressure when the propeller device is rotated about the centerline of the propeller hub. In certain embodiments of the present invention, the plug can be made of a plastic material.

In a typical application of the present invention, a plurality of propeller blades is attached to the propeller hub and a plurality of apertures is formed through the thickness of the propeller hub between the region within the hub and the region proximate an outer surface of the hub. The apertures are formed at positions, relative to the propeller blades, where the pressure is reduced when the hub rotates about its central axis. A plurality of plugs, each having a diametric profile that is shaped to be received and retained in one of the plurality of apertures formed through the thickness of the hub, are provided and each of the plurality of plugs has an opening formed through it.

In certain preferred embodiments of the present invention, a moveable cover is provided within the body of the plug. The cover is shaped to block the opening of the plug when the moveable cover moves radially outward from the central axis of the propeller hub in response to centrifugal force caused by rotation of the propeller device. When the moveable cover is provided within the plug, it allows the opening to be variable in response to the speed of rotation of the propeller device. In other words, if the propeller device is rotating slowly about its central axis, the cover remains displaced from the opening and a fluid, such as exhaust gas, is free to flow through the plug, limited only by the size of the opening within the plug. However, as the rotational speed of the propeller device increases, the centrifugal force operating against the cover causes it to move radially outward relative to the propeller hub and closer to the opening of the plug. In response to significantly high centrifugal forces, the cover can completely close the opening through the plug and the propeller device will operate with no venting from the internal space of the propeller device to the low pressure regions near the outer surface of the propeller hub.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
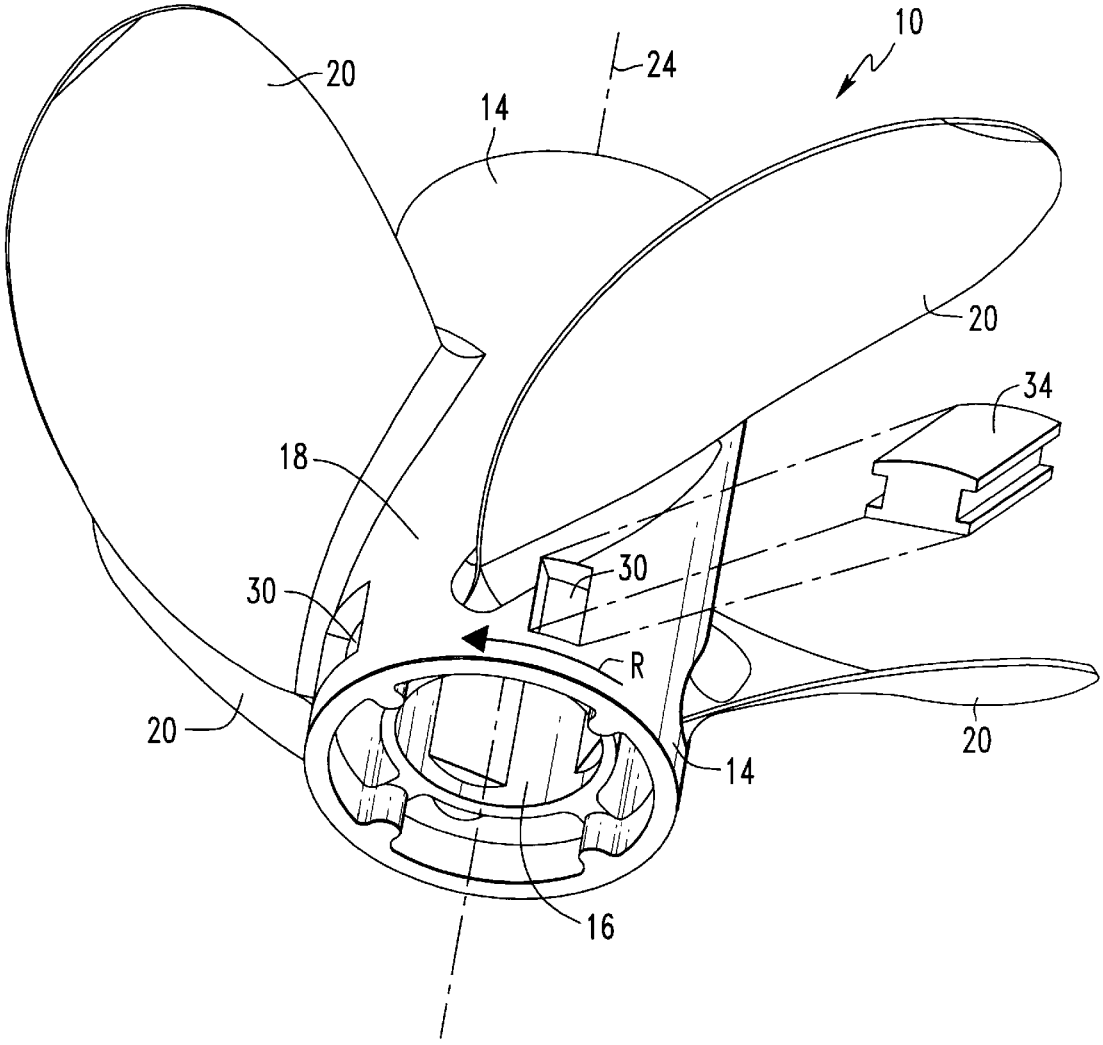
FIG. 1 PRIOR ART
FIG. 1 is a perspective view of a propeller device made in accordance with the prior art.

Throughout the description of the preferred embodiment of the present invention, like components will be identified by like reference numerals.

FIG. 1 shows a typical propeller made according to the concepts known to those skilled in the art. The propeller device 10 comprises a propeller hub 14 that is generally cylindrical in shape, having a cavity region 16 within the propeller hub and an outer cylindrical surface 18. A plurality of propeller blades, 20, is attached to the hub 14 and the blades extend outward from it. The propeller hub 14 is intended to rotate about a central axis 24 in the direction represented by arrow R in FIG. 1.

In propeller devices such as the one illustrated in FIG. 1 with high pitched blades, it is necessary for the propeller blades 20 to move a relatively large volume of water from an essentially stationary condition to a moving condition in a short period of time. When the throttle of an engine is initially actuated and the marine vessel is essentially stationary in the water, the power requirement can possibly tax the engine beyond its capabilities. Those skilled in the art are familiar with the torque versus RPM curves used to describe the characteristics of an engine. When the rotational speed of the propeller 10 is low, such as during initial start-up and acceleration, the torque delivered by the engine is much less than it would be at higher rotational speeds. Unfortunately, the reduced effective horsepower of the engine under these conditions coincides with an increased need for horsepower to move the annular volume of water described by the profile of the blades 20 as they rotate about centerline 24. Therefore, when the engine is required to provide a significant output during acceleration, the ability of the engine to provide the necessary torque is severely compromised by the normally reduced horsepower at low rotational speeds.

In order to alleviate these problems, some propeller devices 10 are provided with vent apertures 30 that are formed through the thickness of the propeller hub 14 between the region 16 within the propeller hub 14 and the region proximate the outer surface 18 of the hub. These venting apertures 30 allow exhaust gas to flow from a higher pressure region within the hub to the lower pressure region near the cylindrical surface 18 and behind the propeller blades 20. It has been found that this flow of fluid alleviates some of the problems described above by displacing water within the annular volume described by the rotation of the blades 20. The exhaust gas displaces the water and, since the density of the exhaust gas is so much less than that of water, the blades 20 can move through the annular volume with much more ease than if the volume was totally filled with water and no gas. In order to accommodate this flow of exhaust gas, the vent apertures 30 are typically provided through the metallic propeller device 10 during its original manufacture.

Unfortunately, when the propeller devices are manufactured, it is impossible to predict the precise type of marine vessel on which they will be used. The same type of propeller device 10 may be used on a relatively light marine vessel with a powerful engine or, alternatively, a heavier marine vessel with an engine having less power. In one instance, with a very powerful engine, the propeller device 10 may work very well without any vent aperture 30. In fact, the existence of exhaust gas within the path of the propeller blades 20 may encourage the propeller blades to "break loose" and result in excess cavitation. This is highly undesirable and typically requires the boat operator to throttle down until the propeller blades once again begin to accelerate the marine vessel. Under circumstances like that described immediately above, it is typical for a boat operator to install the vent plugs 34 in the vent apertures 30 so that no exhaust gas is able to pass from the internal portion of the hub 14 to the region within the volume swept by the blades 20. In the other example described above, where the less powerful engine is used in conjunction with a heavy boat, the vent apertures 30 can provide a valuable advantage by ventilating the annular volume of water swept by the blades 20 and decreasing the resistance provided by that volume of water to the rotation of the propeller device 10. With these two examples in mind, it can easily be imagined that many other combinations of engine horsepower and boat load may require degrees of ventilation between full ventilation with no plug 34 and no ventilation with the plug 34 inserted into the vent aperture 30. According to the prior art, this issue must be resolved under one of two possible situations. Either full ventilation or no ventilation must be selected.

It is also common for a boat owner to purchase a propeller device 10 based on a general consideration of the engine horsepower and boat design. However, after the propeller device 10 is purchased and installed on a marine vessel, it may be discovered that the propeller device provides too much ventilation, resulting in the propellers "breaking loose". However, when the boat owner places the plugs 34 in the ventilation openings 30, it may then be discovered that the engine of the marine vessel has insufficient horsepower to provide a satisfactory acceleration characteristic. In circumstances like this, it would be significantly beneficial if the boat owner could achieve a degree of ventilation somewhere between full ventilation and no ventilation.

One potential solution to this problem is for the manufacturers of propeller devices to cast the propeller devices with different sized ventilation openings so that the boat owner could select a ventilation condition most suitable for the particular marine vessel on which the propeller device will be used. However, in many cases the boat owner is unable to predict how a marine vessel will behave with a particular size of vent aperture. This solution to the problem would require the ability of the boat owner to purchase a propeller, try the propeller on the boat, and return the propeller to the manufacturer or sales outlet where it was purchased if the ventilation situation is not proper. It would be much more beneficial if the boat owner could modify the ventilation apertures after the purchase of the propeller device without the need for replacing the propeller device. In addition, this would allow the propeller manufacturer to make one size of ventilation aperture for all propeller devices, thus reducing manufacturing costs and inventory costs. Furthermore, if the ventilation opening is made to be round, tooling costs can be reduced and easily insertable plastic plugs can be used to solve the problems described above.

Figure 2:
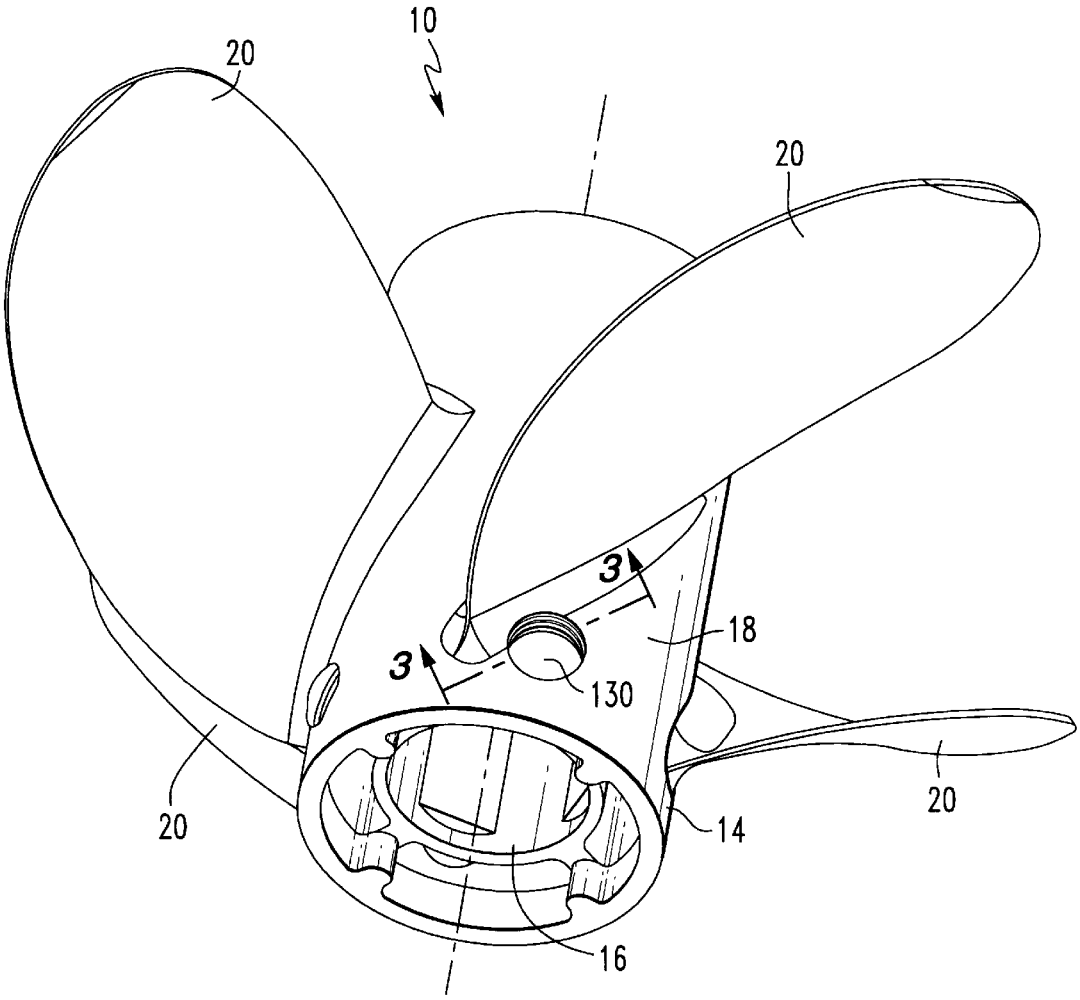
FIG. 2 is a perspective view of a propeller device made in accordance with the present invention.

FIG. 2 shows a propeller device 10 made in accordance with the present invention. The vent aperture 130 is round, but placed generally in the same position as the vent aperture 30 would be placed, as discussed above in conjunction with FIG. 1.

Figure 3:
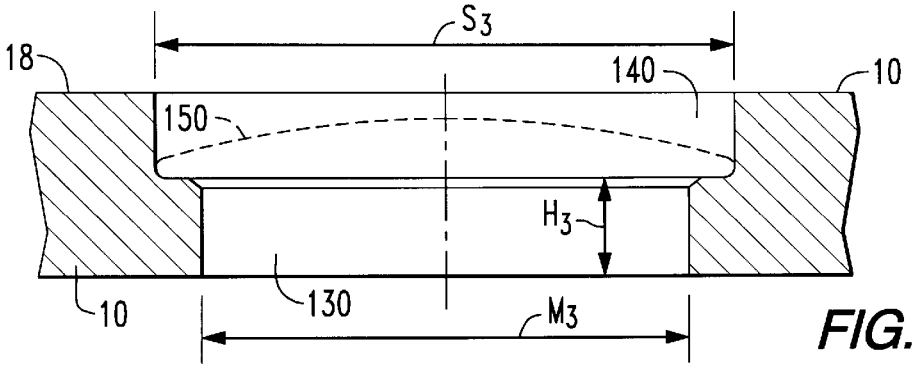
FIG. 3 is a partial sectional view of FIG. 2.

FIG. 3 is a sectional view of the vent aperture 130 of FIG. 2 made in accordance with the present invention. For purposes of simplicity, the section view of FIG. 3 is drawn flat and does not represent the true curvature of the propeller hub 10. A first generally circular opening 140, having an outer diameter $S_3$ is formed in the outer surface 18 of the hub 10. The opening continues through the thickness of the hub 10, but with a slightly smaller diameter $M_3$ as shown in FIG. 3. The smaller diameter extends through the remaining thickness $H_3$ of the hub 10 as shown. It should be understood that alternative aperture configurations can also be used and are within the scope of the present invention.

Figure 4:
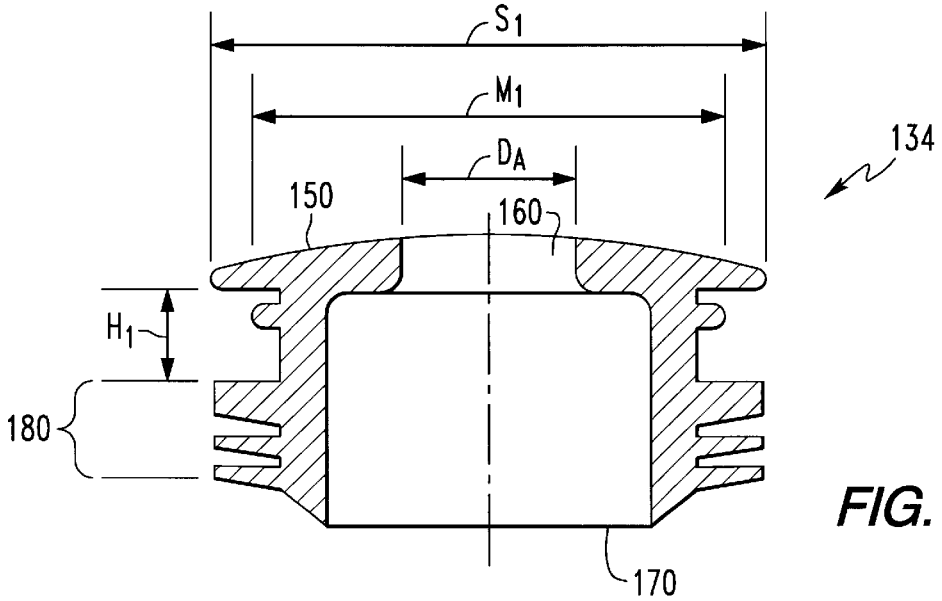
FIGS. 4 and 5 show two alternative embodiments of a vent plug made in accordance with the present invention.

FIG. 4 shows a plug 134 made in accordance with the present invention. The plug 134 has a diametric profile that is shaped to be received and retained within the vent aperture 130 through the thickness of the hub. With reference to FIGS. 3 and 4, dimension $H_1$ is sized to receive the portion of the aperture 130 located between the inside surface of the hub 10 and the opening 140. This dimension is identified as $H_3$. The two dimensions, $H_1$ and $H_3$, are selected so that the plug 134 will be retained within the aperture 130 after it is inserted into the aperture. The cap 150 of the plug 134 is provided with a diameter $S_1$ that can fit within the diameter $S_3$ of opening 140 in the hub 10. Furthermore, the effective diameter $M_1$ of the plug 134 shown in FIG. 4 is able to fit within the diameter $M_3$ of the vent aperture and provide a seal between its outer circumference and the inner circumference of the vent aperture in order to prevent the flow of fluids between the plug and the propeller head 10. The plug 134 shown in FIG. 4 represents one preferred embodiment of the present invention. However, it should be understood that many alternative diametric profiles are within the scope of the present invention and are not limiting to its applicability.

The opening 160 shown in FIG. 4 extends through the plug 134. When a central cavity 170 is provided within the body of the plug 134, the opening 160 cooperates with the cavity 170 to provide a fluid conduit through the plug 134. The combined effect of opening 160 and cavity 170 will be referred to generally herein as caused by opening 160. When the plug 134 is received and retained within vent aperture 130, flow through the aperture is limited to that which can flow through the opening 160, which is significantly reduced relative to the full opening of the vent aperture 130. Depending on the intended application of the plug 134, the opening 160 can be sized to suit a level of improved acceleration that is accommodated without causing the blades to "break loose". Realizing that the propeller device cannot be maximized for all of its range of performance, the vent plug 134 of the present invention allows the boat operator to select an opening size that perfectly suits the combination of engine horsepower and boat characteristics. By providing plugs 134 with openings of various sizes, the boat operator can select a plug with smaller or larger openings, depending on whether the boat requires increased or decreased ventilation. This allows the boat operator to select a magnitude of ventilation anywhere between the full sized ventilation aperture 30 provided with the propeller at manufacture to a fully plugged ventilation opening that results in no ventilation at all.

With reference to FIGS. 3 and 4, the cap 150 of the vent plug 134 is shown by a dashed line in FIG. 3 to represent its position when the plug 134 is inserted into the aperture. The portion of plug 134 identified by reference numeral 180 would be disposed below the inner surface of the hub 10 and the thickness $H_1$ would generally coincide in position with the thickness identified by reference numeral $H_3$.

Figure 5:
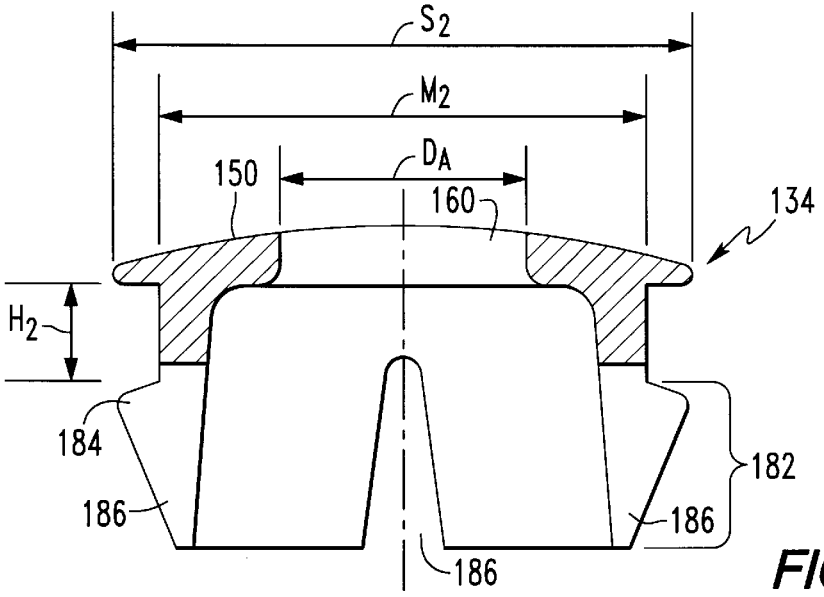

FIG. 5 shows an alternative configuration for a plug 134. The plug in FIG. 5 is intended to operate in a manner which is generally identical to the operation of the plug 134 in FIG. 4. However, the shape has been slightly modified. The portion of the plug 134 identified by reference numeral 182 comprises a protrusion 184 that generally coincides axially with the location of a slot 186. When forced into a vent aperture 130, the slots 186 allow the plug 134 to momentarily compress to a reduced diameter in order to allow the portion 182 of the plug to pass through the vent aperture 130 and its diameter $M_3$. Then, due to the resilience of the material used to make the plug 134, the lower portion 182 expands and retains the plug within the vent aperture. Dimension $S_2$ is selected to allow the cap 150 to fit within the opening 140 which has a diameter $S_3$.

Dimension $M_2$ is selected to allow the plug to be retained within the minimal diameter $M_3$ of vent aperture 130. Therefore, dimensions $H_2$ and $H_3$ are selected to accommodate each other. The cap 150 of the plug 134 shown in FIG. 5 would assume the position of the cap 150 represented by dashed lines in FIG. 3. Both of the vent plugs shown in FIGS. 4 and 5 can be provided with openings 160, having diameters $D_A$ that are selected to provide a pre-selected rate of fluid flow through the plug 134 to maximize the efficiency and operating capability of the propeller device 10.

Figure 6:
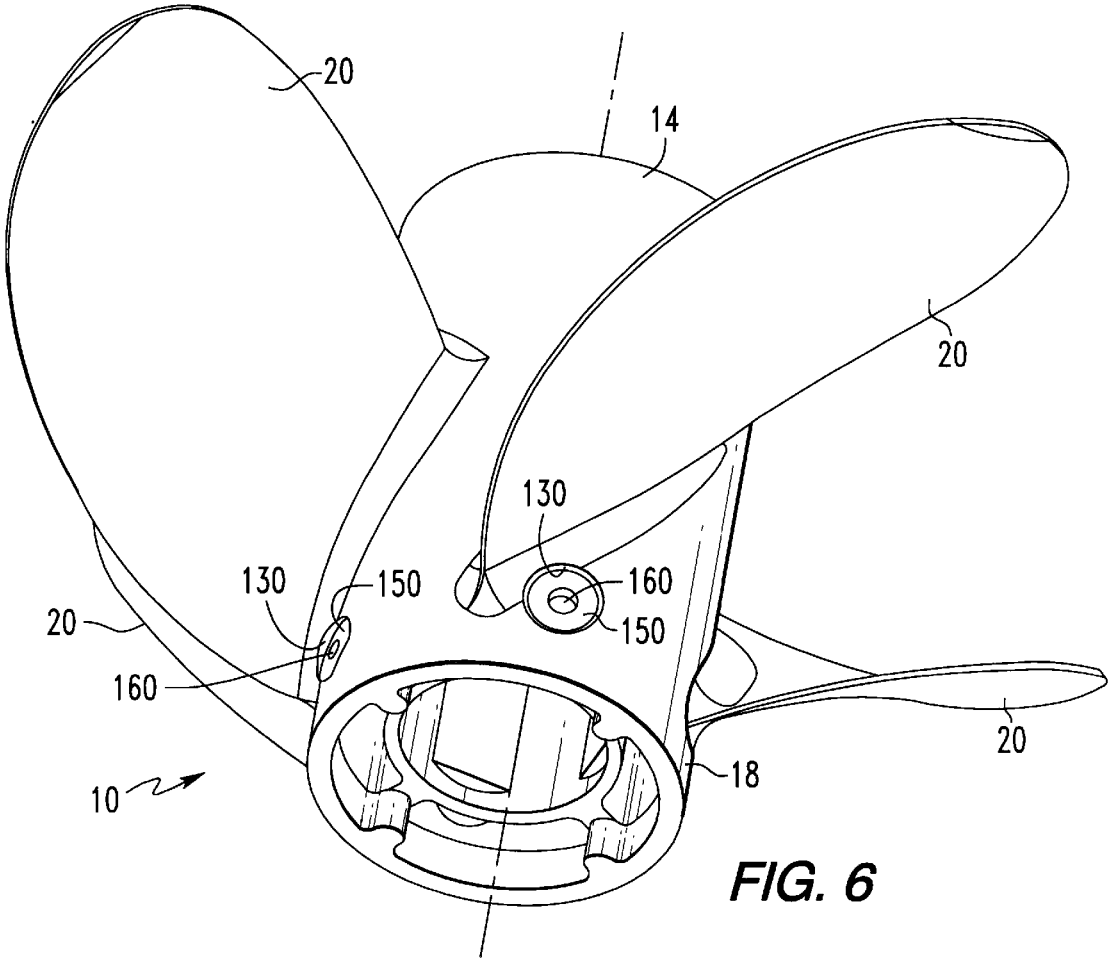
FIG. 6 is an isometric view of a propeller device with a plug inserted into its vent aperture.

FIG. 6 illustrates a propeller 10 with the vent plugs of the present invention inserted into the vent apertures 130. The caps 150 of the vent plugs are visible in FIG. 6. The remaining portions of the vent plugs are disposed within the minimal diameter of the vent apertures 130 and extending into the cavity within the hub and are therefore not visible in FIG. 6.

Figure 7:
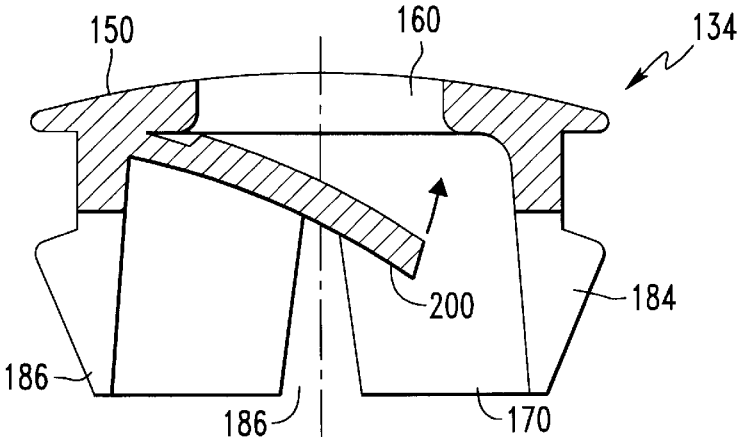
FIG. 7 is a cross-sectional view of an alternative embodiment of the present invention.

FIG. 7 shows an alternative embodiment of the present invention that provides certain operational advantages. It comprises a moveable cover 200 that is disposed within the cavity 170 of the plug 134. When at rest, the cover 200 assumes the position shown in FIG. 7. This leaves the opening 160 with minimal blockage to the flow of fluid upward through the plug 134 in FIG. 7. However, when the propeller device begins to rotate about its central axis, centrifugal force will cause the cover 200 to move upward toward opening 160 and eventually block the opening.

The present invention had several embodiments. In all of the embodiments of the present invention, a vent plug 134 is provided which allows the size of an opening 160 to be specifically selected by a boat operator. The magnitude of the opening 160 is therefore not restricted to the magnitude of the vent aperture 130 originally formed in the hub of a propeller device. Many different sizes of openings can be provided by selecting vent plugs 134 with an appropriate opening size to suit a particular application. In one embodiment of the present invention, a moveable cover is provided within the internal structure of the vent plug in order to allow a variable effective opening which is dependent on the speed of the propeller device. By allowing the boat operator to try plugs with various sized openings, the present invention allows the degree of ventilation to be precisely determined to suit the particular characteristics of the combination of engine horsepower and boat size with which the propeller device is being used. Plugs can be provided with many different sizes of openings so that the operator can exchange the plugs if it is detected that the horsepower of the engine is insufficient to achieve satisfactory acceleration or, alternatively, if the horsepower of the engine is larger than necessary for a particular ventilation hole size. If the engine power is insufficient to achieve a desired acceleration rate, plugs can be selected with relatively large openings or, at an extreme, the ventilation aperture can be used with no plug at all. However, if a selected opening size is too large and results in the propellers "breaking loose", the plugs can be easily changed to provide a smaller ventilation opening. A virtually infinite range of opening choices are available to the boat operator because of the flexibility provided by the present invention. Another benefit of the present invention is that the propeller device manufacturer need only manufacture the propeller devices with the largest possible ventilation opening, knowing that the plugs can be used to modify the size of the ventilation aperture after the propeller device is manufactured.

Although the present invention has been described with considerable specificity and illustrated to show preferred embodiments of the present invention, it should be understood that alternative embodiments are also within its scope.

I claim:

1. A propeller device, comprising:

a propeller hub having a propeller blade extending therefrom, said propeller hub having a central axis;

an aperture formed through a thickness of said propeller hub between a region within said propeller hub and a region proximate an outer surface of said propeller hub;

a plug having a diametric profile shaped to be received and retained within said aperture formed through said thickness of said propeller hub, said aperture being shaped to receive said plug and to retain said plug after said plug is inserted into said aperture, said plug being removable from said aperture; and an opening formed through said plug, said opening providing fluid communication between said region within said propeller hub and said region proximate said outer surface of said propeller hub when said plug is disposed within said aperture.

2. The propeller device of claim 1, wherein:

said aperture is disposed proximate a side of said blade which experiences a reduced pressure when said propeller device is rotated about said centerline of said propeller hub.

3. The propeller device of claim 1, wherein:

said plug is made of a plastic material.

4. The propeller device of claim 1, wherein:

a plurality of said blades are attached to said propeller hub;

a plurality of said apertures are formed through said thickness of said propeller hub between said region within said propeller hub and said region proximate said outer surface of said propeller hub; and a plurality of said plugs, each of said plugs having said diametric profile shaped to be received and retained within one of said plurality of apertures formed through said thickness of said propeller hub, each of said plugs having said opening formed through it, each of said plurality of apertures being shaped to receive one of said plurality of plugs and to retain said one of said plurality of plugs after said one of said plurality of plugs is manually inserted into said aperture.

5. The propeller device of claim 1, further comprising:

a movable cover disposed within said plug shaped to block said opening when said movable cover moves radially outward from said central axis of said propeller hub in response to centrifugal force caused by rotation of said propeller device.

6. A propeller device, comprising:

a propeller hub having a plurality of propeller blades extending therefrom, said propeller hub having a central axis;

a plurality of apertures formed through a thickness of said propeller hub between a region within said propeller hub and a region proximate an outer surface of said propeller hub;

a plurality of plugs having a diametric profile shaped to be received and retained within one of said plurality of apertures formed through said thickness of said propeller hub, each of said plurality of apertures being shaped to receive one of said plurality of plugs and to retain said one of said plurality of plugs after said one of said plurality of plugs is inserted into said aperture, said one of said plurality of plugs being removable from at least one of said plurality of apertures; and an opening formed through each of said plurality of plugs, each of said openings providing fluid communication through its associated plug between said region within said propeller hub and said region proximate said outer surface of said propeller hub when said associated plug is disposed within said aperture.

7. The propeller device of claim 6, wherein:

each of said apertures is disposed proximate a side of an associated one of said plurality of blades which experiences a reduced pressure when said propeller device is rotated about said central axis of said propeller hub.

8. The propeller device of claim 7, wherein:

each of said plurality of plugs is made of a plastic material.

9. The propeller device of claim 8, further comprising:

a movable cover disposed within each of said plurality of plugs and shaped to block said opening when said movable cover moves radially outward from said central axis of said propeller hub in response to centrifugal force caused by rotation of said propeller device.

10. A propeller device, comprising:

a propeller hub having a plurality of propeller blades extending therefrom, said propeller hub having a central axis;

a plurality of apertures formed through a thickness of said propeller hub between a region within said propeller hub and a region proximate an outer surface of said propeller hub, each one of said plurality of apertures being shaped to receive a plug and to retain said plug after said plug is manually inserted into said one of said plurality of apertures, said plug having a diametric profile shaped to be received and retained within said one of said plurality of apertures formed through said thickness of said propeller hub, said plug being manually removable from at least one of said plurality of apertures; and an opening formed through said plug, said opening providing fluid communication through said plug between said region within said propeller hub and said region proximate said outer surface of said propeller hub when said plug is manually disposed within said aperture, each of said apertures being disposed proximate a side of an associated one of said plurality of blades which experiences a reduced pressure when said propeller device is rotated about said central axis of said propeller hub.

11. The propeller device of claim 10, wherein:

said plug is made of a plastic material.

12. The propeller device of claim 11, further comprising:

a movable cover disposed within each of said plurality of plugs and shaped to block said opening when said movable cover moves radially outward from said central axis of said propeller hub in response to centrifugal force caused by rotation of said propeller device.

* * * * *